US008414462B2

(12) United States Patent
Clougherty et al.

(10) Patent No.: US 8,414,462 B2
(45) Date of Patent: Apr. 9, 2013

(54) APPARATUS AND METHOD OF MAKING A PAPER END WITH A PRESSED CHUCK WALL

(75) Inventors: Kenan J Clougherty, Hartsville, SC (US); Kenneth Weltlich, Collierville, TN (US); Slawek Witkowski, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 168 days.

(21) Appl. No.: 13/006,663

(22) Filed: Jan. 14, 2011

(65) Prior Publication Data

US 2012/0184421 A1 Jul. 19, 2012

(51) Int. Cl.
*B31B 1/88* (2006.01)
*B65B 61/00* (2006.01)

(52) U.S. Cl.
USPC ..... 493/58

(58) Field of Classification Search ..... 493/58, 493/59, 63, 83, 86, 89, 344, 353, 463; 53/410, 53/129.1
See application file for complete search history.

(56) References Cited

U.S. PATENT DOCUMENTS

| | | | |
|---|---|---|---|
| 1,975,150 | A | 10/1934 | Henry |
| 2,314,338 | A | 3/1943 | Graves et al. |
| 2,423,965 | A | 7/1947 | Coyle |
| 2,595,046 | A | 4/1952 | Amberg |
| 3,258,954 | A | 7/1966 | Dennis |
| 3,912,154 | A | 10/1975 | Godar |
| 3,983,827 | A | 10/1976 | Meadors |
| 4,046,306 | A | 9/1977 | Cass |
| 4,228,121 | A | 10/1980 | Meadors |
| 4,303,190 | A | 12/1981 | Ditto et al. |
| 5,476,213 | A | 12/1995 | Suski |
| 5,901,902 | A | 5/1999 | Grabher |
| 6,053,400 | A | 4/2000 | Rea |
| 6,065,634 | A | 5/2000 | Brifcani et al. |
| 6,361,485 | B1 | 3/2002 | Robertson |
| 7,143,623 | B1 | 12/2006 | Turnbull et al. |
| 7,281,649 | B2 | 10/2007 | Pyper et al. |

*Primary Examiner* — M. Alexandra Elve
*Assistant Examiner* — John Paradiso
(74) *Attorney, Agent, or Firm* — Miller, Matthias & Hull LLP

(57) ABSTRACT

A novel method and apparatus is provided for forming a pressed paper end which minimizes or eliminates deformations in the chuck wall. The method involves using a novel die press apparatus in which, at the very end of the compression stroke, the paper is held tightly by the opposing dies on either side of the chuck wall forming area, and the chuck wall forming area is held in substantial confinement between the dies.

4 Claims, 9 Drawing Sheets

APPARATUS AND METHOD OF MAKING A PAPER END WITH A PRESSED CHUCK WALL

BACKGROUND OF THE INVENTION

1. Field of the Invention

This invention patent relates to an apparatus and method of making a paper end for a rigid cylindrical or shaped container. More particularly, this invention relates to an apparatus and method of making a pressed paper end that minimizes or eliminates wrinkles, waves and other deformations in the paper end chuck wall.

2. Description of the Related Art

Rigid cylindrical and shaped composite containers used to package goods such as snacks and other food items are an important product in the packaging industry. These containers usually are manufactured with open ends, one of which may be closed with a metal, plastic or paper bottom closure. The top end may be sealed with a paper or composite end that is adhered to the container top rim but that can be easily removed by the consumer.

There are three basic types of paper ends for use in sealing rigid composite containers. The first type is a stiff paper disc that often is fitted within an internal groove near the bottom of the container. The bottom rim below the groove may be serrated and then curled inward against the inside surface of the container and glued thereto to help hold the paper end in place. Examples of this type of closure can be found on containers for dry food products such as bread crumbs and stuffing.

The second type of paper end is a cup-shaped structure having a central panel and a skirt. This second type of paper closure typically is made by cutting paperboard into a circular blank and then using an annular ring device to simultaneously insert the blank into the open bottom end of a container while forming the closure into a cup shape. The resulting container will have a recessed bottom, and the container body (bottom rim) may be curled inwardly around the paper end skirt.

The third type of paper end, which is the subject of the present invention, is a stamped paper end which has been pre-formed by a die press similar to those used to make metal ends. Like the second type of paper end, stamped paper ends typically have a flat central panel and an annular (circumferential) skirt, referred to as a chuck wall. The chuck wall abuts the inner surface of the container body when the paper end is inserted into a container.

To make a stamped (or pressed) paper end, flat paperboard material is fed into a die press (a.k.a. stamping press) and then compressed between upper and lower opposing dies. In standard die presses (like the kind used to form metal ends), the chuck wall is created by forming/stretching the paper material along two areas of compression on either side of the chuck wall while the chuck wall itself is relatively unsupported.

The problem with this forming method is that it can create wrinkles, waves or other deformations in the chuck wall. Deformations in the chuck wall area are particularly troublesome because, when the pre-formed (pressed) paper end is inserted into the container body, these deformations can interfere with the proper sealing of the container.

A further problem can arise when pressed paper ends are installed onto a container. Inserting the end into the container can create a pressure seal so air inside the container cannot escape. As soon as the sealed container is ejected from the seal head, this excess internal pressure can put stress on the still hot, malleable paper end and thermo-polymer sealant, resulting in an undesirable domed appearance or, worse, a weak or failed end seal.

Another problem can occur when the end of the container near the paper end is squeezed or otherwise compressed. These compression forces can create stress on the paper end, which can result in deformation or failure of the seal.

Yet another problem can occur when containers with pressed paper ends are exposed to lower ambient pressures (such as can occur when the containers are transported across high elevations). Under these conditions the pressure inside the container can cause the paper end to deform outwardly.

Thus there is a need for an improved apparatus and method of forming a pressed paper end that eliminates tears, wrinkles, waves or other deformations in the chuck wall of the paper end when the paper ends are formed.

There is also a need for a method of forming a paper end that allows for the formation of venting channels in the chuck wall area so air inside the container can be released during the end closure insertion process or during exposure to lower ambient pressures.

There is also a need for a paper end closure that allows the container at the end/body interface to compress and absorb shocks near the paper end without destroying the seal.

There is also a need for a paper end that can be vented if the pressure inside the container becomes too great relative to the ambient (outside) pressure.

Further and additional objects will appear from the description, accompanying drawings, and appended claims.

BRIEF SUMMARY OF THE INVENTION

The present invention fulfills these needs by providing a novel apparatus and method for forming pressed paper ends for use in sealing containers which minimizes or eliminates deformations in the chuck wall. The method involves using a novel die press apparatus in which, at the very end of the compression stroke, the paper is held tightly by the opposing dies on either side of the chuck wall forming area while the chuck wall forming area is sandwiched between the dies. This intimate contacting of the paper material on either side of the chuck wall area by the upper and lower dies keeps the chuck wall flat and smooth as the end is being formed, thereby preventing the formation of wrinkles, waves and other deformations in the chuck wall.

DETAILED DESCRIPTION OF THE INVENTION

Figure 1:
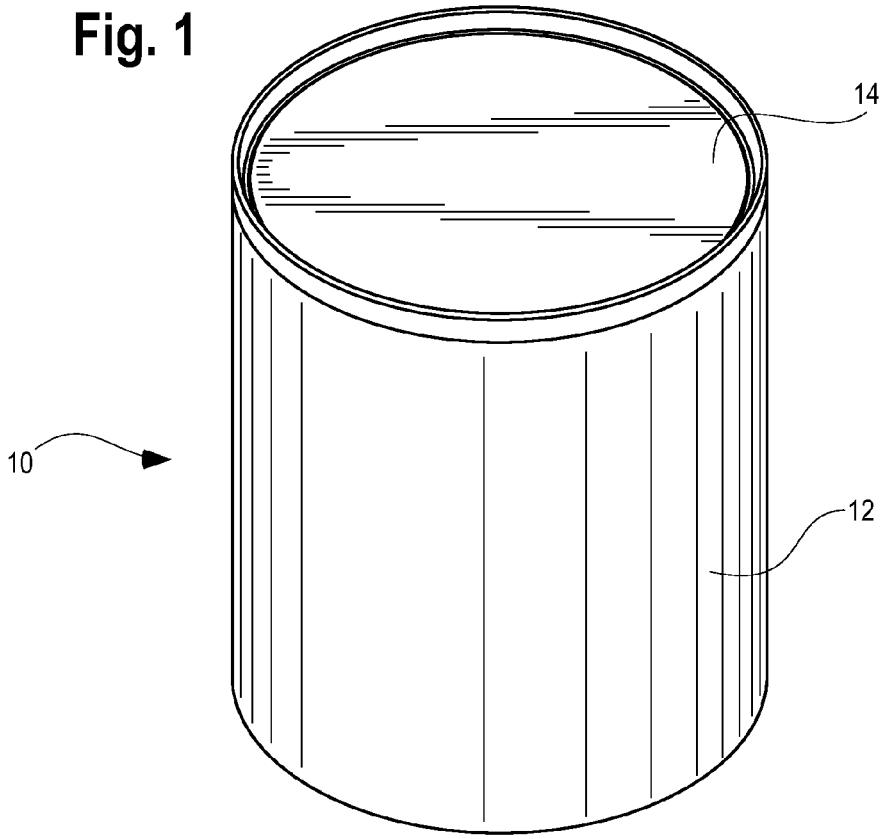
FIG. 1 is a perspective view of a rigid composite container sealed with a pressed paper end.

While this invention may be embodied in many forms, there is shown in the drawings and will herein be described in detail one or more embodiments, with the understanding that this disclosure is to be considered an exemplification of the principles of the invention and is not intended to limit the invention to the illustrated embodiments.

The present invention is a novel apparatus and method for forming pressed paper ends that are used in sealing rigid cylindrical or shaped (non-cylindrical) composite containers which minimizes or eliminates deformations in the chuck wall. The method involves using a novel die press apparatus in which, at the very end of the compression stroke, the paper is held tightly by the opposing dies at two areas, one on either side of the chuck wall forming area, while the chuck wall forming area is "sandwiched" between the dies. That is to say, both sides of the chuck wall are in substantially complete contact with the opposing dies at the very end of the compression stroke. This sandwiching of the paper material at the chuck wall forming area by the upper and lower dies keeps the chuck wall flat and smooth as the end is being formed, thereby preventing the formation of wrinkles and waves in the chuck wall.

Rigid Composite Containers

Rigid composite containers are used to package various products such as snacks and other food items. These containers often comprise a rigid cylindrical or shaped body usually manufactured with open top and bottom ends. One or both ends may be sealed with paper-based ends or ends made of metal, flexible polymer material, or composite materials. While the bottom end is usually affixed to the container, the top end is often designed to be easily removed by the consumer.

Figure 2:
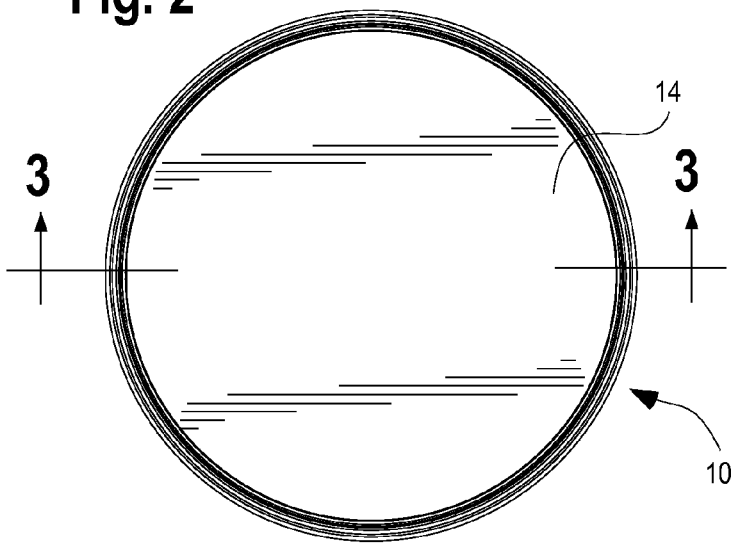
FIG. 2 is a top plan view of the composite container of FIG. 1.

FIG. 1 is a perspective view of a sample rigid composite container 10, and FIG. 2 is a top plan view of the rigid composite container of FIG. 1. The container 10 comprises a rigid cylindrical body 12 terminating in a top rim 18 and having a top opening and a bottom opening. The bottom opening is sealed with a bottom end or closure (not shown). The top opening is sealed with a pressed paper end 14 made according to the present invention and described in more detail below.

The Paper End

Figure 3:
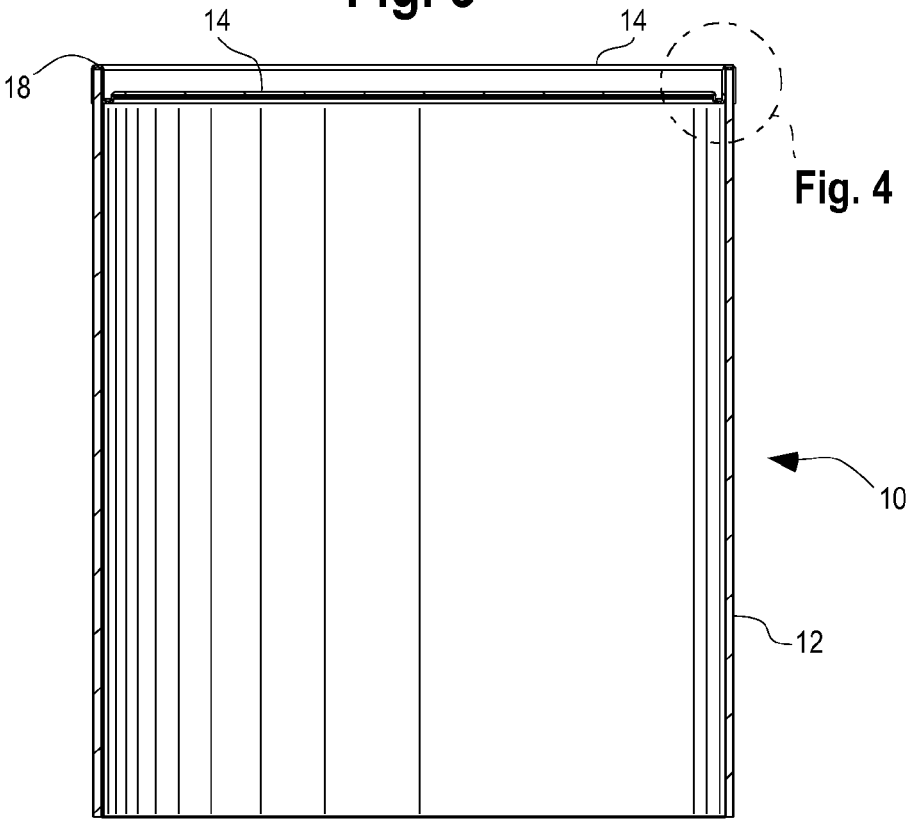
FIG. 3 is a cross-sectional view of the composite container of FIG. 2 taken along line 3-3.
Figure 4:
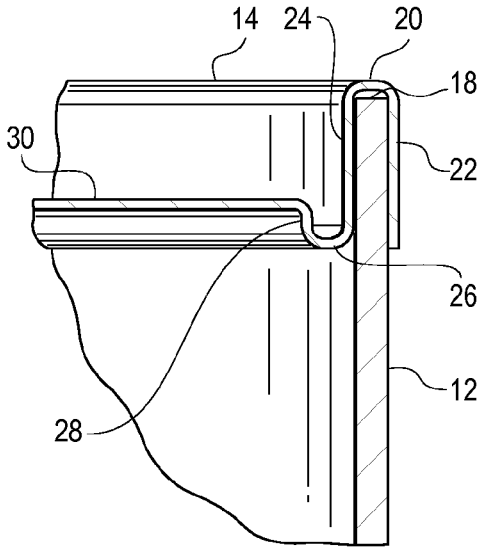
FIG. 4 is a close up view of a portion of the composite container of FIG. 3 showing the paper end in more detail.

FIG. 3 is a cross-sectional view of the composite container 10 of FIG. 2 taken along line 3-3. FIG. 4 is a close up view of a portion of the composite container 10 of FIG. 3 showing the paper end 14 in more detail. When fitted into the container 10 and sealed thereto, the pressed paper end 14 comprises a narrow annular rim 20 adjacent to and overlaying the container top rim 18, an outer skirt or flange 22 that extends downward from the annular rim 20 adjacent the outer surface of the container sidewall 12, an annular chuck wall 24 that extends downward from the annular rim 20 adjacent the inner surface of the container sidewall 12, and a container covering portion. The covering portion comprises an annular peripheral area 26 at the base of the chuck wall 24, a sidewall 28 that extends upward from the annular peripheral area 26, and a raised circular central panel 30 terminating in a periphery coextensive with the sidewall 28. The central panel 30 is raised above the annular peripheral area 26 but below the plane defined by the container rim 18. While the paper end 14 is made primarily of paper and other fiber based material, it may also contain non-fiber barrier layers made from metal or plastic.

As best shown in FIG. 4, the paper end 14 is countersunk with respect to the container top rim 18. The countersink portion is made up of the chuck wall 24, the annular peripheral area 26, the sidewall 28 and the raised central panel 30, all of which extend below the container top rim 18. The countersink portion is extra deep (about 4-6 mm below the top rim 18 compared to about 3 mm for conventional ends). The extra deep countersink and raised central panel 30 allow the container 10 to compress and absorb shocks at the container/paper end interface during insertion of the paper end 14 into a container 10, assuring that any barrier materials contained in the paper end 14 are not torn or fractured, thereby maintaining barrier performance. The extra deep countersink portion and raised central panel 30 also help absorb compression forces during handling.

Figure 5:
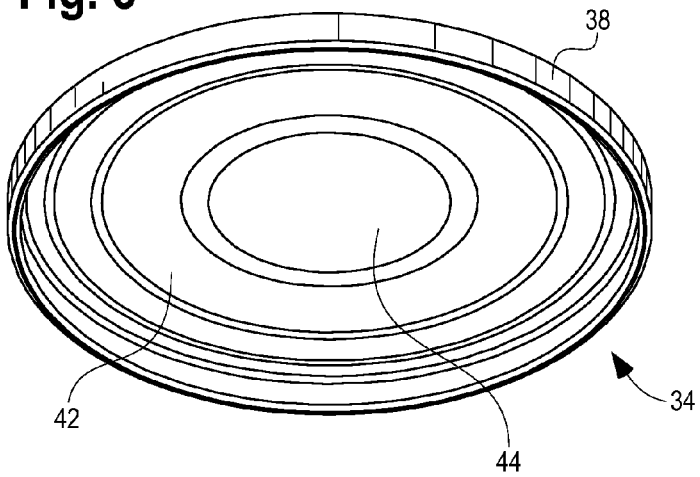
FIG. 5 is a perspective view of a second embodiment of a pressed paper end after the outer flange portion has been wiped down.
Figure 6:
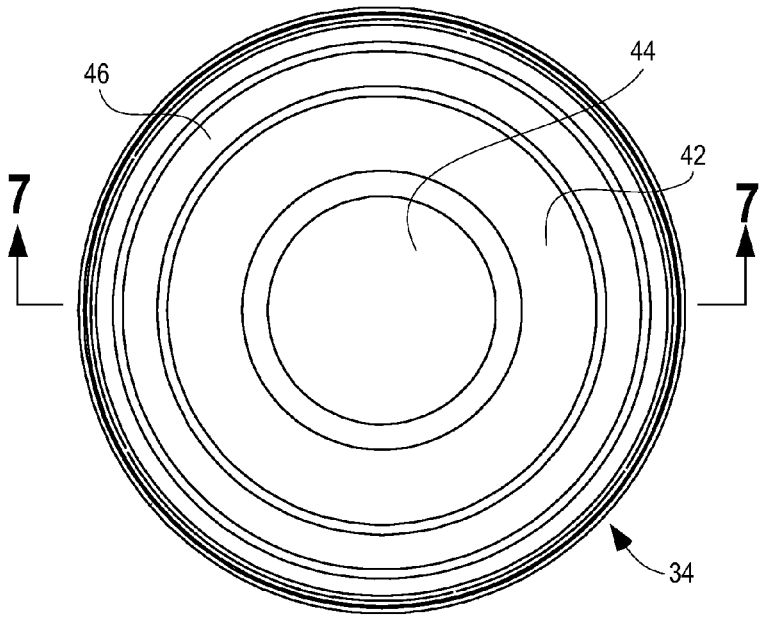
FIG. 6 is a top plan view of the paper end of FIG. 5.
Figure 7:
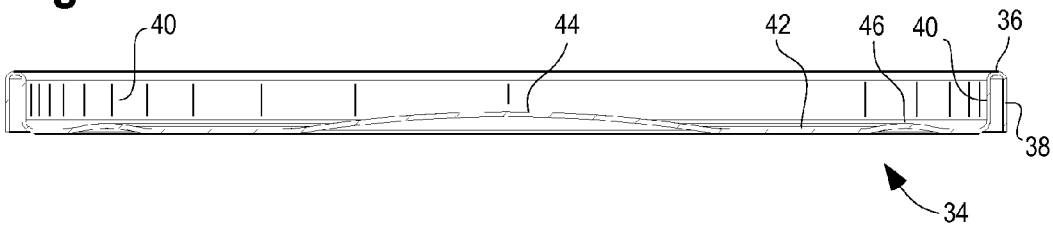
FIG. 7 is a cross-sectional view of the paper end of FIG. 6 taken along line 7-7.

FIGS. 5-7 show three views of a second pressed paper end 34 made according to the present invention. Like the first pressed paper end 14, this pressed paper end 34 comprises an annular rim 36, an outer skirt or flange 38 that extends downward from an outer edge of the annular rim 36, an annular chuck wall 40 that extends downward 4 to 6 mm from the inner edge of the annular rim 36, and a covering portion 42. Unlike the first paper end 14, this paper end 34 does not have a raised central panel. However, the covering portion 42 does have a domed or crowned center area 44 and a concentric raised ring 46 spaced from and surrounding the dome 44. The dome 44 and raised ring 46 help prevent the otherwise flat covering portion 42 from becoming warped during manufacture and use. The outer flange 38 extends straight outward when removed from the die press. FIGS. 5-7 show the paper end 34 with the outer flange 38 extending down as it would appear after the end 34 has been wiped down and sealed to a container body.

Stamping

Stamping is a process for making formed articles from flat pieces of metal or other material using a die press or stamping press. In a typical stamping operation a sheet of material is fed into a reciprocating die press having opposing dies. In a typical die press the dies are of complimentary shapes and one die is moveable relative the other die. The dies usually are made of tool steel to withstand the extreme stamping pressures and repeated impact forces.

After the material is fed between the dies, the upper die moves down and compresses the material against the lower die so that the material assumes the desired shape. At the point of greatest compression, the dies define a space therebetween that approximates the thickness of the sheet material. After the compression stroke, the upper die is raised so the newly formed part can be removed from the stamping area.

Conventional Die Press

Figure 8:
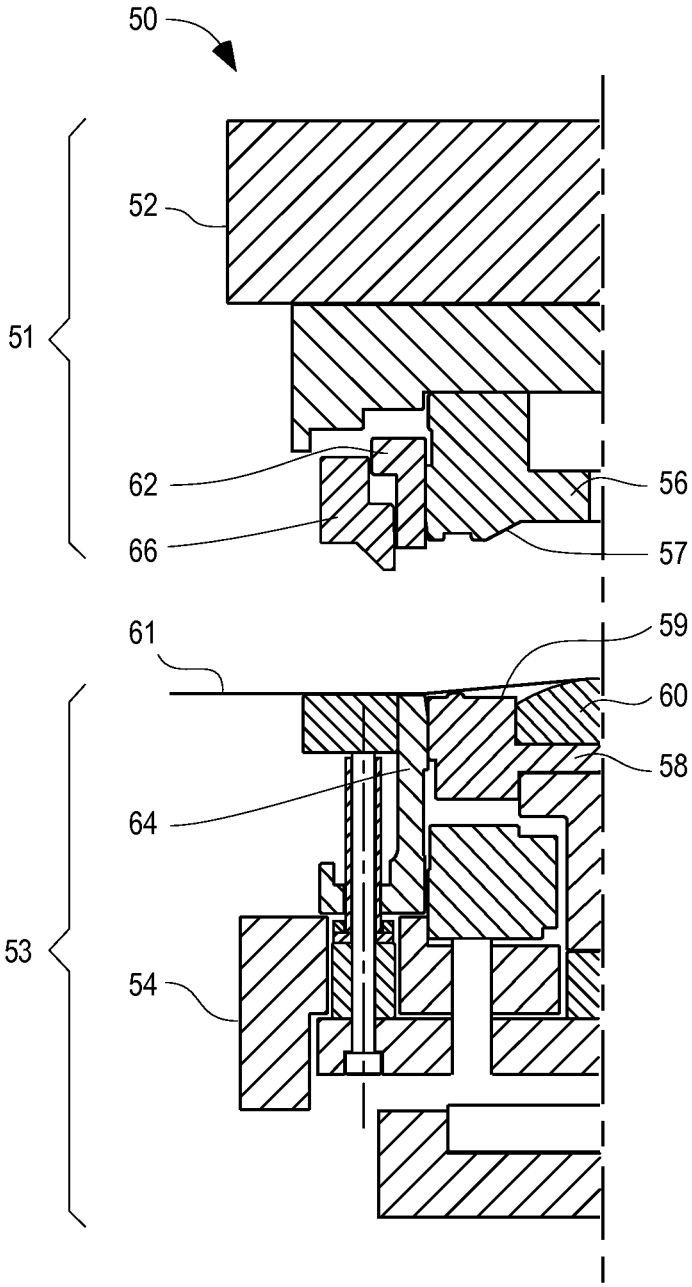
Fig. 8 Prior Art
FIG. 8 is a cross sectional view of a conventional die press before a compression stroke.
Figures 9, 10:
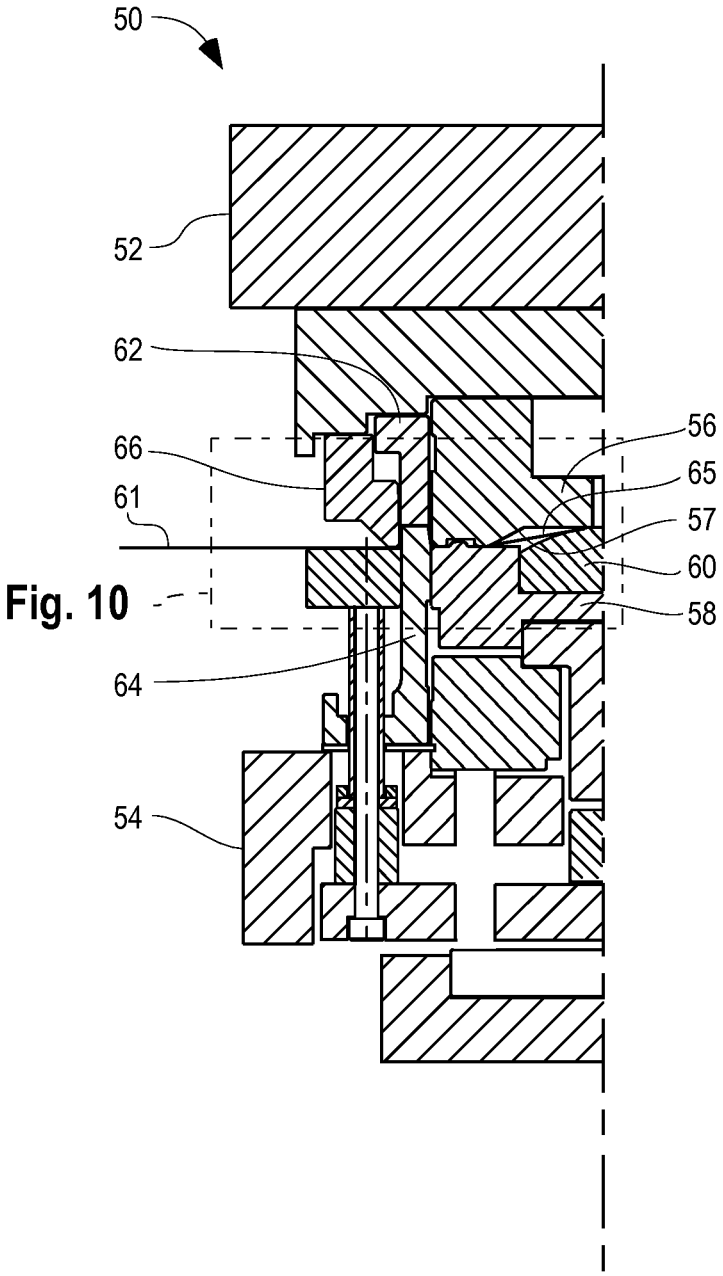
Fig. 9 Prior Art
FIG. 9 is a cross sectional view of a conventional die press at the moment of greatest compression.
FIG. 10 is an enlarged view of a portion of the conventional die press of FIG. 9.
Figure 10:
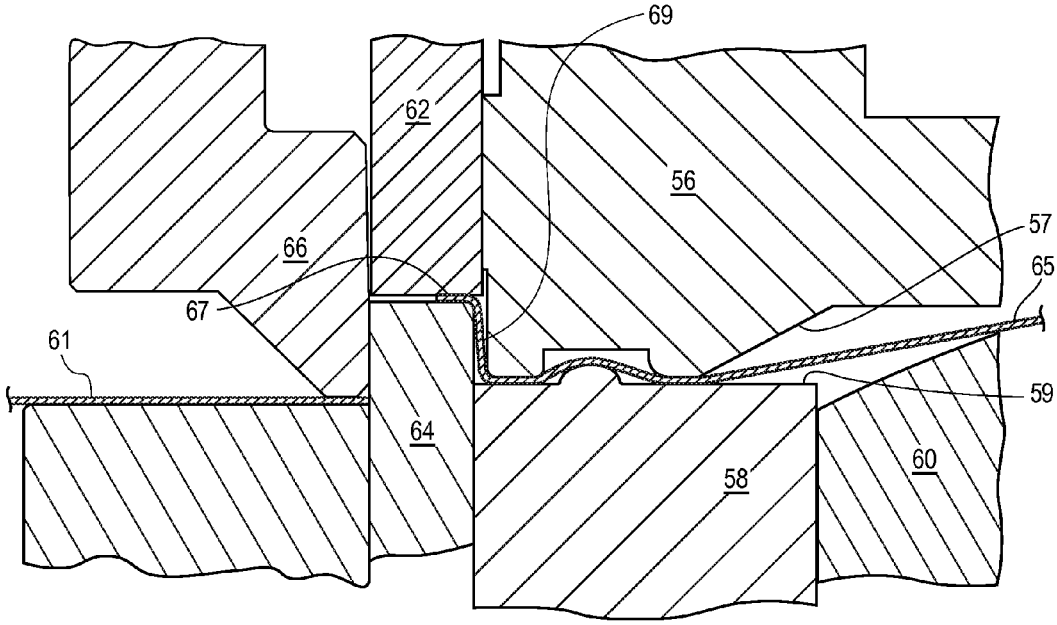
Fig. 10 Prior Art

A conventional die press 50 is shown in FIGS. 8-10. The die press 50 comprises an upper tool section 51 and a lower tool section 53. The upper tool section 51 comprises an upper die shoe 52 movable relative to the lower tool die 53 and which carries a male upper die center 56 having a first forming surface 57. The lower tool die 53 comprises a lower die shoe 54 that holds a female lower die center 58 having a second forming surface 59 in confronting relationship with the first forming surface 57. The lower die center 58 also carries a dome punch 60 having a convex upper surface.

An upper draw ring 62 surrounds the upper die center 56 and is moveable with respect to the upper die shoe 52. The upper draw ring 62 and the upper die center 56 may be either spring or pneumatically cushioned. The upper draw ring 62 and upper die center 56 may be cushioned by an upper spring means (not shown). The upper die shoe 52 also carries an upper cutting edge 66 for cutting a paper disk 65 (FIG. 9) from a feed web 61.

The lower die center 58 is yieldably supported on the lower die shoe 54 by lower spring means (not shown). A lower cutting punch 64 surrounds the lower die center 58 and is mounted to the lower die shoe 54 in fixed relation thereto. The lower cutting punch 64 is stationary.

Significantly, as best shown in FIG. 10, the upper die center 56 and the lower cutting punch 64 have vertically opposing cylindrical walls. That is, their respective wall facing surfaces form vertically oriented concentric cylinders spaced slightly apart to accommodate the chuck wall portion of a pressed paper end. As a result, the chuck wall is substantially vertical at the moment of greatest compression.

Making a Paper End with the Conventional Die Press

The conventional die press 50 is shown in FIGS. 9 and 10 making a conventional paper end disk or closure 65, at the moment of greatest compression. At the initial contact of the upper tool section 51 to the feed web of paper, the upper draw ring 62 and the lower cutting punch 64 clamp the periphery (end flange portion 67) of the paper disk 65 as the upper cutting edge 66 shears the paper end disk 65 from the feed web 61. After the paper end disk 65 is clamped and cut from the rest of the feed web 61, the upper die center 56 moves downward and forces the paper end disk 65 toward the lower die center 58 while the upper draw ring 62 and the lower cutting punch 64 maintain tension on the end flange portion 67 of the disk 65.

At the point of greatest compression, the upper die center 56 compresses the formed paper disk 65 against the lower die center 58. The end chuck wall 69 is free floating, meaning it is suspended substantially vertical between the lower cutting punch 64 and the upper die center 56 with little other support. Little or no compression of the chuck wall 69 takes place.

A problem with using a conventional die press to form a pressed paper end is that conventional die presses can create wrinkles, waves or other deformations in the paper end chuck wall. Deformations in the chuck wall area are particularly troublesome because, when the formed (pressed) paper end is inserted into the container body, these deformations can interfere with the proper sealing of the container.

The Novel Die Press Apparatus

Figure 11:
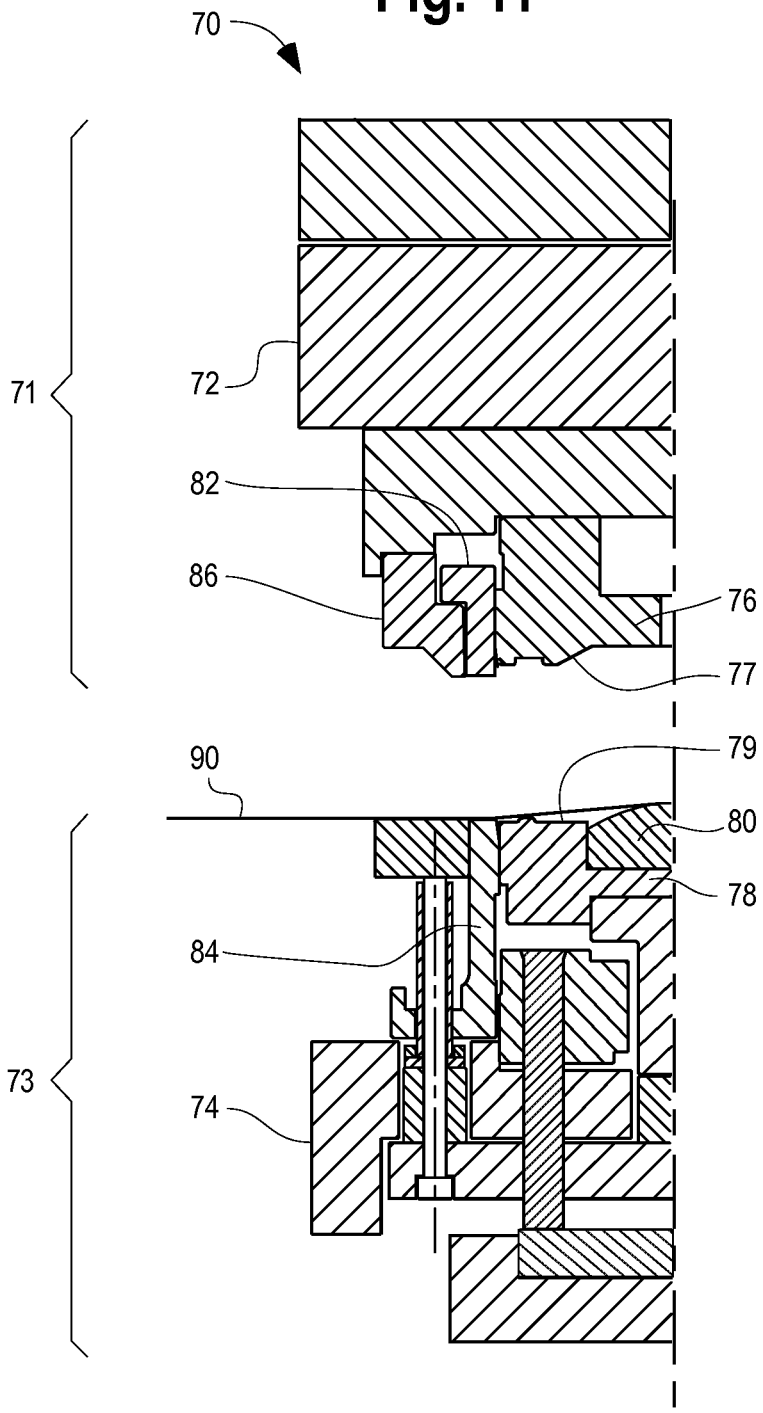
FIG. 11 is a cross sectional view of a die press according to the present invention before a compression stroke.
Figure 12:
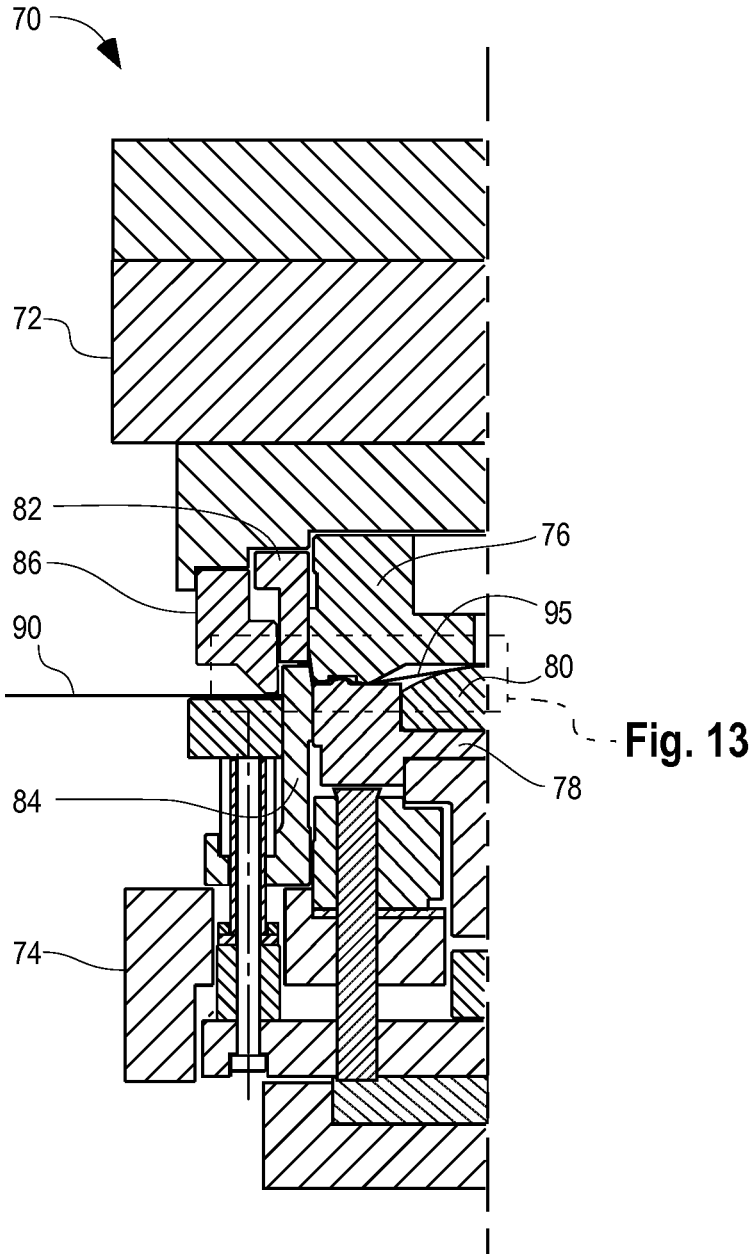
FIG. 12 is a cross sectional view of the die press of FIG. 10 at the moment of greatest compression.
Figure 13:
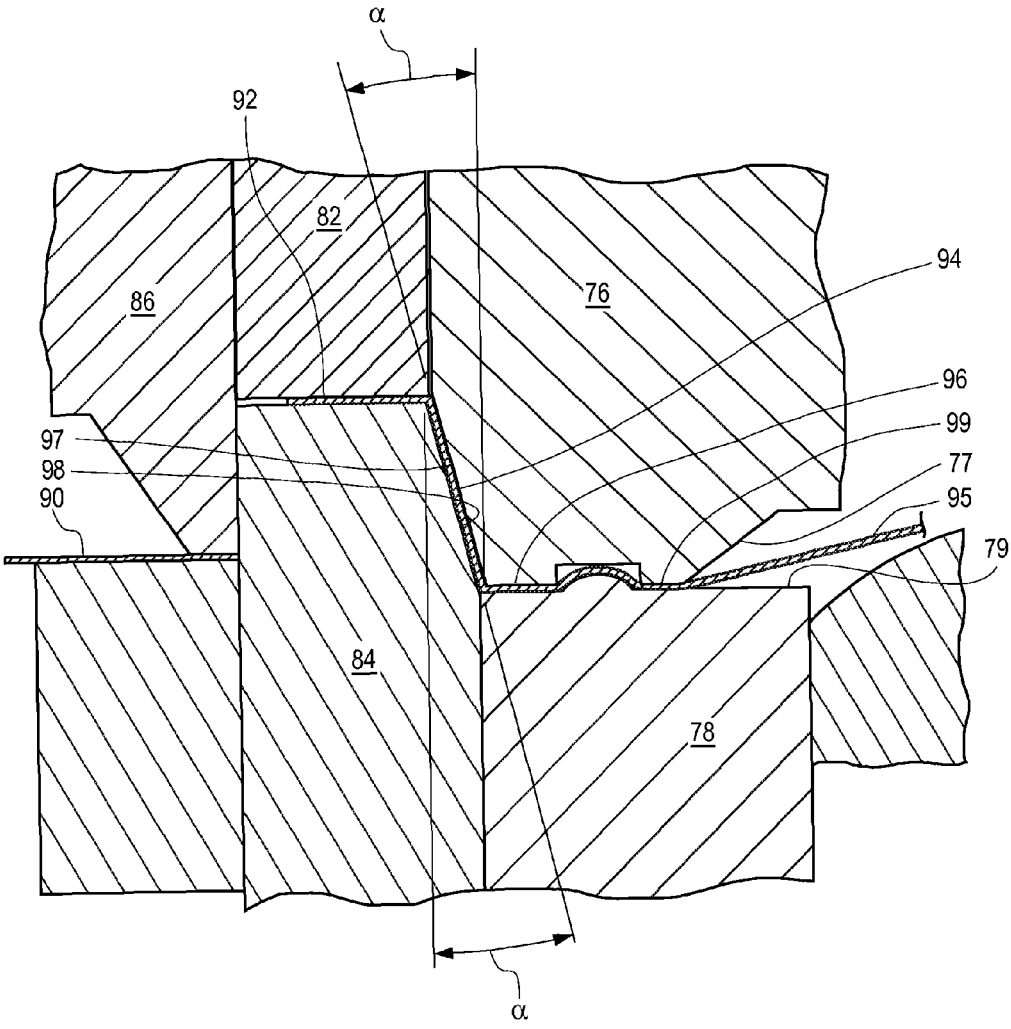
FIG. 13 is an enlarged view of a portion of the die press of FIG. 12.

To solve this problem a novel die press is provided as shown in FIGS. 11-13. Like the conventional die press 50, the die press 70 of the present invention comprises an upper tool section 71 movable relative to a lower tool section 73.

The upper tool section 71 comprises an upper die shoe 72 that carries a male upper die center 76 having a first forming surface 77, an upper draw ring 82 and an upper cutting edge 86 used to cut a paper disk 95 from the feed web 90. The upper draw ring 82 and the upper die 86 may be either spring or pneumatically cushioned.

The lower tool section 73 comprises a lower die shoe 74 that holds a female lower die center 78 having a second forming surface 79 in confronting relationship with the first forming surface 77, and a lower cutting punch 84 that vertically opposes the upper draw ring 82. The lower die center 78 carries a dome punch 80 having a convex upper surface. The lower cutting punch 84 is stationary.

In an important aspect of the invention, as best shown in FIG. 13, the upper die center 76 and the lower cutting punch 84 have matching (complimentary), non-vertical surface wall angles, as opposed to the conventional die press of FIG. 10 in which the upper die center and lower cutting punch each have vertical walls. More specifically, the outer facing wall 97 of the upper die center 76 (abutting one side of the chuck wall area 94) is shaped substantially like an inverted truncated cone and forms an angle $\alpha$ with the vertical. Similarly, the inner facing wall 98 of the lower cutting punch 84 (abutting the other side of the chuck wall area 94) is shaped substantially like a right-side up truncated cone and forms the same angle $\alpha$ from the vertical. The benefit of this novel configuration is explained below.

Making a Pressed Paper End With the Novel Die Press

The pressed paper end 95 may be made in the following manner.

Feeding Step

To begin the process of making a pressed paper end, a paperboard web 90 is fed into the die press 70 and positioned in the die press 70 on top of the lower die center 78 as shown in FIG. 11. This is typically done while the upper tool section 71 is moving up.

Forming Operation Begins/Cutting Step

As the forming operation begins, the upper tool section 71, including the upper die center 76 and the upper draw ring 82, advances downward until the upper draw ring 82 cooperates with the lower cutting punch 84 to clamp the flange area 92 of the paper disk 95, while the upper cutting edge 86 shears the end disk 95 from the feed web 90.

After the paper end disk 95 is clamped at flange area 92 and cut from the rest of the feed web 90, the upper die center 76 continues to move downward, forcing the paper end disk 95 toward the lower die center 78 while the upper draw ring 82 and the lower cutting punch 84 maintain tension (clamping force) on the flange area 92. During the compression stroke the flange area 92 remains clamped between the upper draw ring 82 and the lower cutting punch 84 but is allowed to slip a little between the upper draw ring 82 and the lower cutting punch 84 to prevent tearing of the flange area 92.

In a key aspect of the invention, during the compression stroke, the facing walls 97, 98 of the upper die center 76 and the lower cutting punch 84 come together at an angle, that is, they slide laterally with respect to each other, which serves to "iron out" any wrinkles or waves in the chuck wall area 94.

Compression Step

FIGS. 12 and 13 show the die press at the point of greatest compression. At this point the paper disk 95 is compressed between the upper die center 76 and the lower die center 78 to form the pressed paper end 95. At the moment of greatest compression the peripheral area 96 of the covering portion is compressed between the upper and lower die centers 76, 78 while as noted above the flange area 92 remains clamped between the upper draw ring 82 and the lower cutting punch 84. (Depending on the type of end being made, the annular area 99 of the covering portion may also be compressed between the upper and lower die centers 76, 78.) This compression of the flange area 92 and peripheral area 96 occurs at the end of the compression stroke (at the time of greatest compression), so there is very little movement of these two areas of the disk 95 with respect to each other.

In a key aspect of the invention, the entire chuck wall area 94 is completely sandwiched (held in substantial lateral confinement) between the upper and lower dies. More specifically, the entire chuck wall area 94 is sandwiched between the matched, angled walls of the upper die center 76 and the lower cutting portion 84 so that movement of the chuck wall area 94 is severely restricted. This "sandwiching" prevents unwanted deformation of the chuck wall area 94. The chuck wall area 94 can be held with minimum force between the upper die center 76 and the lower cutting punch 84 or can be compressed between the upper die center 76 and the lower cutting punch 84 to iron out any deformations or wrinkles that may have been created prior to the compression stroke.

The minimum chuck wall draft angle of a conventional press is normally between 4 and 20 degrees. This pressed paper end invention prefers a 1 to 10 degree chuck wall angle ($\alpha$), but the compression of the chuck wall is the most critical factor.

Removal of Completed Part

After the stamping operation the pressed paper end 95 is removed from the die press 70 and the process is begun again.

Benefits of Confining the Chuck Wall Area

Forming a paper end with a deep countersink and a raised central panel requires more paper and subjects that paper to considerably more pulling during compression than forming, say, a flat paper end with little or no countersink. This extra pulling can result in extreme wrinkle or wave formation. However, confining (sandwiching) the chuck wall area 94 during the making of the paper end 95 by using the novel die press arrangement 70 described above reduces and/or "irons out" any wrinkles or waves in the chuck wall area 94.

Sandwiching the chuck wall area 94 also eliminates the problem of pressure build up during insertion of the end 95 into a container. The ability of the tool die chuck wall forming components to partially compress the chuck wall area 94 permits the formation of optional venting channels (not shown in the figures) in the chuck wall area 94. These venting channels allow trapped air to be released during the insertion process, and can be pressed out during the heat seal step by the compression action of the sealing head. The venting channels can either be convex or concave relative to the sealing surface of the end 95, so the male die which helps form the channels can be placed on either the upper or lower die, with the complimentary female die on the opposite die.

The Present Invention is Intended for Paper End Forming and Not Metal End Forming The present invention is designed specifically for forming paper ends, and should not be used in forming metal ends due to possible damage to the die tooling. Sandwiching the chuck wall between the upper die center and the cutting punch—as is done in the present invention—can be dangerous when used with metal material because the tooling can bottom out prematurely and crash the die set, causing parts breakage. Due to variations in the thickness of the metal material, the die tool set in a metal end forming process is not able to come into intimate contact (compression) with the chuck wall area. If the metal stamping material has variable thickness, as the die upper center and the cutting punch approach each other they will contact the material at different times in the stroke. (The thicker the material the earlier the opposing parts will meet.) Since the steel has very little compression capability, the two opposing tool parts can "bottom out" before the end of the stroke.

However, when forming paper ends according to the present invention, the paper in the pressed paper end can compress slightly between the opposing tool parts to absorb their force and prevent tool crashes. The paper can have variations in material thickness (like steel often does), but paper is able to be compressed much more than the steel, so the stroke can be completed before any of the tools parts can break.

Installing the Formed Paper End Onto a Can or Container

To install a paper end onto a container, the container is placed in a sealing machine and the end is positioned on one end of the container with the flange area extending outwardly from the container rim. Adhesive, thermopolymer or other binding means may be applied to the container inner wall, paper end chuck wall or both. A sealing head or other suitable device forces the paper end onto the container until the chuck wall area abuts the container inner wall, while simultaneously folding the outer skirt or flange against the container outer sidewall. Heat (preferred method) may be applied to adhere the end to the container.

If the chuck wall area includes venting channels, air can escape from the container during the insertion step. The venting channels then can be pressed out during the heat seal step by the compression action of the sealing head.

Summary

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A method of forming a pressed paper end which mitigates wrinkling or tearing of the paper end, the paper end having a circular covering portion having a peripheral area, an annular chuck wall area extending from the covering portion to an annular rim, and a flange area extending from the annular rim, the method comprising the steps of:

(a) providing a die press having an upper tool section moveable relative to a lower tool section, an upper draw ring surrounding the upper die center, and an upper cutting edge, the upper tool section comprising a male upper die center having an outer facing wall shaped like an inverted truncated cone and forming an angle $\alpha$ with the vertical, the lower tool section comprising a lower cutting punch having an inner facing wall shaped like a right-side up truncated cone and forming the same angle $\alpha$ with the vertical;

(b) feeding a paper based web to the die press;

(c) advancing the upper tool section toward the lower tool section until the upper draw ring cooperates with the lower cutting punch to clamp the flange area of the paper disk while allowing the flange area to slip a little between the upper draw ring and the lower cutting punch;

(d) shearing the paper end from the feed web by the upper cutting edge;

(e) forcing the paper end disk toward the lower die center while the upper draw ring and the lower cutting punch maintain tension on the flange area;

(f) bringing the upper die center and the lower cutting punch together so that the chuck wall is squeezed between the outer facing wall and the inner facing wall; and (g) forming the pre-pressed paper end.

2. The method of claim 1 wherein during step f the peripheral area is compressed between the upper and lower die centers while tension is maintained on the flange area.

3. The method of claim 2 wherein during step f the entire chuck wall area is held in substantial lateral confinement between the upper and lower tool sections.

4. A method of forming a pressed paper end having a circular covering portion having a peripheral area, an annular chuck wall area extending from the covering portion to an annular rim, and a flange area extending from the annular rim, the method comprising the steps of:

(a) providing a die press comprising an upper tool section moveable relative to a lower tool section, the upper tool section comprising a male upper die center having a first forming surface and an outer facing wall shaped like an inverted truncated cone and forming an angle $\alpha$ with the vertical, an upper draw ring surrounding the upper die center, and an upper cutting edge for cutting a paper disk from a feed web, the lower tool section comprising a female lower die center having a second forming surface in confronting relationship with the first forming surface and a lower cutting punch surrounding the lower die center and having an inner facing wall shaped like a right-side up truncated cone and forming the same angle $\alpha$ with the vertical, (b) feeding a paper based web to the die press;

(c) advancing the upper tool section toward the lower tool section until the upper draw ring cooperates with the lower cutting punch to clamp the flange area of the paper disk while allowing the flange area to slip a little between the upper draw ring and the lower cutting punch;

(d) shearing the paper end from the feed web by the upper cutting edge;

(e) forcing the paper end disk toward the lower die center while the upper draw ring and the lower cutting punch maintain tension on the flange area; and (f) holding the chuck wall area at an angle to the vertical and in substantial lateral confinement between the outer facing wall and the inner facing wall while compressing a portion of the paper end between the upper die center and the lower die center to form the pressed paper end.

* * * * *